US005320768A

United States Patent [19]

Gutierrez et al.

[11] Patent Number: 5,320,768

[45] Date of Patent: Jun. 14, 1994

[54] HYDROXY ETHER AMINE FRICTION MODIFIER FOR USE IN POWER TRANSMISSION FLUIDS AND ANTI-WEAR ADDITIVES FOR USE IN COMBINATION THEREWITH

[75] Inventors: Antonio Gutierrez, Mercerville; Jack Ryer, East Brunswick; Robert S. Johnson, Edison; Stanley J. Brois, Westfield, all of N.J.; Jon M. Clumpner, Delavan, Wis.

[73] Assignee: Exxon Chemical Patents Inc., Linden, N.J.

[21] Appl. No.: 85,247

[22] Filed: Jun. 29, 1993

Related U.S. Application Data

[63] Continuation of Ser. No. 839,668, Feb. 19, 1992, abandoned, which is a continuation of Ser. No. 698,239, May 6, 1991, abandoned, which is a continuation of Ser. No. 211,240, Jun. 24, 1988, abandoned.

[51] Int. Cl.[5] ..... C10M 133/08; C10M 137/02

[52] U.S. Cl. ..... 252/49.6; 252/49.8; 252/49.9; 252/51.5 R; 252/77; 252/78.5

[58] Field of Search ..... 252/49.8, 51.5 R, 77, 252/78.5, 49.6

[56] References Cited

U.S. PATENT DOCUMENTS

| | | | |
|---|---|---|---|
| 2,151,300 | 3/1939 | Moran | 252/49.9 |
| 2,290,880 | 7/1942 | Katzman et al. | 252/33 |
| 2,316,082 | 4/1943 | Loane et al. | 252/32.7 R |
| 2,316,088 | 4/1943 | Loane et al. | 252/32.7 R |
| 2,805,217 | 9/1957 | Loughran et al. | 252/46.6 |
| 2,806,022 | 9/1957 | Sabol | 252/32.7 HC |
| 2,917,160 | 12/1959 | Turinsky | 252/51.5 R |
| 3,034,907 | 5/1962 | Kleemann et al. | 252/51.5 A |
| 3,175,976 | 3/1965 | Foehr | 252/75 |
| 3,186,946 | 6/1965 | Sluhan | 252/49.3 |
| 3,235,501 | 2/1966 | Waldmann | 252/49.6 |
| 3,254,025 | 5/1966 | Le Suer | 252/32.7 |
| 3,255,253 | 6/1966 | Kuryla | 564/505 |
| 3,394,179 | 7/1968 | Younghouse | 564/15 |
| 3,456,012 | 7/1969 | Swenson | 564/504 |
| 3,464,925 | 9/1969 | Benoit et al. | 252/77 |
| 3,484,375 | 12/1969 | Hu | 252/49.9 |
| 3,509,052 | 4/1970 | Murphy | 252/34.7 |
| 3,511,780 | 5/1970 | Neblett et al. | 252/32.7 |
| 3,513,093 | 5/1970 | Le Suer | 252/32.5 |
| 3,645,886 | 2/1972 | Gillespie et al. | 252/68 |
| 3,705,139 | 12/1972 | Yamane et al. | 524/173 |
| 3,850,822 | 11/1974 | Steere et al. | 252/34.7 |
| 3,933,659 | 1/1976 | Lyle et al. | 252/32.7 E |
| 4,010,106 | 3/1977 | Rothert | 252/32.7 E |
| 4,129,508 | 12/1978 | Friihauf | 252/33 |
| 4,170,560 | 10/1979 | Lowe | 252/47.5 |
| 4,201,684 | 5/1980 | Malec | 252/47.5 |
| 4,208,293 | 6/1980 | Zaweski | 252/51.5 A |
| 4,231,883 | 11/1980 | Malec | 252/33.4 |
| 4,382,006 | 5/1983 | Horodysky | 252/49.6 |
| 4,474,674 | 10/1984 | Gutierrez et al. | 252/47.5 |
| 4,486,324 | 12/1984 | Korosec | 252/49.3 |
| 4,529,528 | 7/1985 | Horodysky | 252/49.6 |
| 4,557,845 | 12/1985 | Horodysky et al. | 252/49.9 |
| 4,568,472 | 2/1986 | Horodysky et al. | 252/49.6 |
| 4,594,171 | 6/1986 | Horodysky et al. | 252/49.6 |
| 4,634,543 | 6/1987 | Okada et al. | 252/78.5 |
| 4,650,865 | 3/1987 | Lange et al. | 544/174 |
| 4,664,826 | 5/1987 | Gutierrez et al. | 252/482 |
| 4,704,217 | 11/1987 | Sweeney et al. | 252/32.7 E |
| 5,078,893 | 1/1992 | Ryer et al. | 252/49.8 |
| 5,194,166 | 3/1993 | Burt et al. | 252/49.8 |

FOREIGN PATENT DOCUMENTS

| | | |
|---|---|---|
| 1906038 | 2/1969 | Fed. Rep. of Germany . |
| 1299534 | 11/1961 | France . |
| 2172284A | 3/1986 | United Kingdom . |

*Primary Examiner*—Ellen M. McAvoy

*Attorney, Agent, or Firm*—Theodore J. Shatynski

[57] ABSTRACT

Oleaginous compositions comprising a fuel oil or a lubricating oil, a friction modifying amount of a hydroxy ether amine compound such as that having the formula:

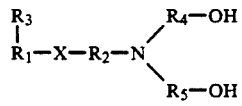

where X is O or S, $R_3$ is H, $R_1$ is $C_{18}$ alkylene, $R_2$ is $C_3$ alkylene, and $R_4$ and $R_5$ are $C_2$ alkylene, and, optionally an amount effective to impart anti-wear properties to the composition of an organic phosphite ester, such as triphenyl phosphite, are disclosed.

9 Claims, No Drawings

HYDROXY ETHER AMINE FRICTION MODIFIER FOR USE IN POWER TRANSMISSION FLUIDS AND ANTI-WEAR ADDITIVES FOR USE IN COMBINATION THEREWITH

This is a continuation of application Ser. No. 839,668, filed Feb. 19, 1992, now abandoned, which is a continuation of U.S. Ser. No. 698,239, filed May 6, 1991, now abandoned, which is a continuation of U.S. Ser. No. 211,240, filed Jun. 24, 1988, now abandoned.

BACKGROUND OF THE INVENTION

The present invention relates to certain hydrocarbon soluble or dispersible hydroxy ether amine friction modifying additives for oleaginous compositions including fuel oil and lubricating oils, such as greases, industrial oils, gear oils, power transmitting fluids, engine lubricating oils, and particularly automatic transmission fluids, and to the oleaginous compositions in which they are contained.

There are many instances, as is well known, particularly under boundary lubrication conditions where two moving surfaces in contact with each other must be lubricated, or otherwise protected, so as to prevent wear, and to insure continued movement. There are other instances where friction between two rubbing surfaces is sought to be modified but not necessarily minimized. By controlling friction between two surfaces, the power required to impart movement from one surface to another is also controlled.

For example, a specialized property sought to be imparted to certain lube oil compositions adapted for use as an automatic transmission fluid is the friction modification characteristic of the fluid. This property distinguishes automatic transmission fluids (ATF) from other lubricants, and in fact between types of ATFs as well. Such characteristic quality has received the most attention by both the transmission manufacturers and fluid producers for many years. This attention stems from the fact that the friction requirements of an ATF are unique and depend on the transmission and clutch design, as well as on the type of clutch plate material used.

Another property sought to be imparted to lubricating oil compositions including automatic transmission fluids is reduced wear such as bearing and power component wear.

As is also well known, both wear and friction modification can be controlled through the addition of suitable additives with varying degrees of success.

While there are many known additives which may be classified as anti-wear, or friction modifying agents, it is also known that many of these additives act in a different physical or chemical manner and often compete with one another, e.g. they may compete for the surface of the moving metal parts which are subjected to lubrication. Accordingly, extreme care must be exercised in the selection of these additives to insure compatibility and effectiveness.

The metal dihydrocarbyl dithiophosphates are one of the additives which are known to exhibit anti-oxidant and anti-wear properties. The most commonly used additives of this class are the zinc dialkyl dithiophosphates (ZDDP) which are conventionally used in lubricant compositions. While such zinc compounds afford excellent oxidation resistance and exhibit superior anti-wear properties, they can be corrosive.

Both anti-wear and friction modifying agents function by forming a coating on the surface of the moving metal parts. The coating bonds are generally affected physically and/or chemically. Consequently, if the bonding between the anti-wear agent and the metal part is stronger than the bonding between the friction modifying agent and the metal part, the anti-wear agent will displace the friction modifying agent at the metal surface, i.e. at the metal/fluid lubrication boundary interface. This results in a loss in the ability of the friction modifying agent to exert its intended effect.

Various tests have been designed by auto manufacturers for measuring ATF friction and anti-wear properties to evaluate the performance of additives in view of the requirements of particular transmission designs and their ability to impart transmission durability and smooth shifting under a variety of road conditions.

Friction modification is typically evaluated on an SAE No. 2 friction apparatus. In this test, the motor and flywheel of the friction machine (filled with fluid to be tested) are accelerated to constant speed, the motor is shut off and the flywheel speed is decreased to zero by application of the clutch. The clutch plates are then released, the flywheel is again accelerated to constant speed, and the clutch pack which is immersed in the test fluid is engaged again. This process is repeated many times with each clutch engagement being called a cycle.

During the clutch application, friction torque is recorded as a function of time. The friction data obtained are either the torque traces themselves or friction coefficients calculated from the torque traces. The shape of the torque trace desired is set by the auto manufacturers. One way of expressing this shape mathematically is to determine the torque: (a) when the flywheel speed is midway between the maximum constant speed selected and zero speed (such torque measurement is referred to herein as $T_D$) and (b) when as the flywheel speed approaches zero rpm (such torque measurement is referred to herein as $T_O$). Such torques can then be used to determine the torque ratio which is expressed as $T_O/T_D$, or alternatively, to determine the torque differential which is expressed as $T_O-T_D$. The optimum target values for torque ratio and torque differential are set by the auto manufacturers. As the $T_O/T_D$ increasingly exceeds 1, a transmission will typically exhibit shorter harsher shifts as it changes gears. On the other hand as $T_O/T_D$ decreases below 1, there is an increasingly greater danger of clutch slippage when the transmission changes gears. Similar relationships exits with respect to a $T_O-T_D$ target value of 0.

While many automatic transmission fluids can achieve target values of $T_O/T_D$ after a minimum number of cycles, it becomes increasingly more difficult to sustain such target values as the number of cycles are increased. The ability of an ATF to sustain such desired friction properties is referred to herein as friction stability or durability. A high level of friction stability is difficult to achieve with ATFs containing certain anti-wear additives. It is believed that as the ATF ages under the influence of the heat of friction, the anti-wear agent can break down and the decomposition products displace conventional friction modifiers at the metal/fluid lubrication boundary interface. As a result, the fluid may exhibit varying friction properties.

Attempts to improve friction stability by simply adding more friction modifier have not met with success because this tends to reduce the breakaway static torque ($T_S$) of the fluid. This parameter when expressed as the breakaway static torque ratio ($T_S/T_D$) reflects the relative tendency of engaged parts, such as clutch packs, bands and drums, to slip under load. If this value is too low, the slippage can impair the driveability and safety of the vehicle.

Very recently, more stringent requirements relating the automatic transmission fluids have been set by one or more auto manufacturers. The desire to enhance fuel economy has resulted in downsizing of cars and power trains, smaller engines and higher shift speeds, and increased usage of torque converter clutches, sprag clutches, and a shift to front wheel drive.

Thus, transmission designs have undergone radical changes, thereby necessitating the formulation of ATF additives capable of meeting new and more stringent property requirements needed to match such design changes.

No base oil alone can even approach the many special properties required for ATF service. Consequently, it is necessary to employ several chemical additives, each of which is designed to impart or improve a specific property of the fluid. Consequently, it becomes particularly advantageous when one additive can perform more than one function, thereby reducing the number of additives needed to be present in the formulation.

Accordingly, there has been a continuing search for new additives possessed of one or more properties which render them suitable for use in ATF compositions, as well as other oleaginous compositions. There also has been a search for new combinations of additives which not only provide ATF compositions, as well as other oleaginous compositions, with the various specific properties that are required, but which are compatible with each other in the sense that they do not exhibit any substantial tendency to compete with each other, nor to otherwise reduce the effectiveness of the various additives in the compositions. The present invention was developed in response to this search.

U.S. Pat. No. 2,290,880 discloses ethers of alcohol amines which may be used as interface modifying agents in a wide variety of arts. The compounds are said to be useful in lubricating oils and the like, thus enabling the production of effective boring oils, cutting oils, drilling oils, wire drawing oils, extreme pressure lubricants and the like.

U.S. Pat. No. 3,255,253 discloses amine-containing polyols which are prepared by first cyanoethylating an alcohol in the presence of a basic catalyst. The cyanoethylated alcohol is then hydrogenated to produce a primary amine, whereafter the primary amine is reacted with an alkylene oxide in the presence of a basic catalyst to form the desired amine-containing polyol. The amine-containing polyols are said to be useful for preparing polyurethane products, as hardeners for polyepoxide resins, and in the preparation of coatings and plasticizers.

U.S. Pat. No. 3,456,012 relates to polyolefin adducts of gamma-alkoxypropylamines having surfactant properties.

U.S. Pat. No. 3,464,925 relates to hydraulic fluids which contain certain aminotriols. The aminotriols are obtained by heating propylene oxide and triisopropylamine under pressure, in the presence of an alkaline catalyst.

U.S. Pat. No. 3,705,139 discloses alkyl sulfide compounds of the formula:

$$R_1\text{-}S\text{-}R\text{-}_2\text{-}A\text{-}(R_3O)\text{-}_nZ,$$

where $R_1$represents a hydrocarbyl radical having 6 to 22 carbon atoms, $R_2$ and $R_3$ each represents a hydrocarbyl radical having 1 to 4 carbon atoms, A can represent nitrogen, n represents an integer in the range of 0–100, and Z can represent hydrogen. The alkyl sulfide compounds are disclosed as being antistatic agents.

U.S. Pat. No. 4,201,684 relates to lubricating oil adapted for use as a crankcase lubricant in internal combustion engines containing a friction reducing amount of a sulfurized fatty acid amide, ester or ester-amide of an oxyalkylated amine.

U.S. Pat. No. 4,231,883 relates to the use of an alkoxylated hydrocarbyl amine in a lubricating oil or fuel to reduce the friction of an internal combustion engine in which the lubricating oil or fuel is used. An example of the alkoxylated hydrocarbyl amine compounds that are disclosed in this patent is N,N-bis(2-hydroxyethyl) oleylamine.

U.S. Pat. No. 4,486,324 discloses an aqueous hydraulic fluid comprising at least 80% water and containing a hydrocarbyl-substituted succinic acid, a zinc dihydrocarbyl dithiophosphate, a hydroxyalkylamine, sodium alkyl benzene sulfonate, and optionally, a polyalkylene glycol mono-fatty acid ester.

U.S. Pat. No. 4,650,865 relates to a process for preparing tertiary ether amines which exhibit surface active properties. The tertiary ether amines may be used as surfactants and as starting materials for the production of surface active derivatives, such as for example, amineoxides and quaternary ammonium compounds.

U.S. Pat. No. 4,129,508 relates to lubricant and fuel compositions characterized by improved demulsifying properties. The patent discloses an automatic transmission fluid which includes a number of additives including a dialkyl phosphite, the reaction product of a polyisobutenyl-substituted succinic anhydride, commercial tetraethylene pentamine, and boric acid prepared as set forth in U.S. Pat. No. 3,254,025, and a conventional friction modifier based on bishydroxyethyl tallow amine (Ethomeen T/12), the reaction product of polyisobutenyl succinic anhydride and an ethylene polyamine, and Ethomeen C/15.

U.S. Pat. No. 2,151,300 relates to lubricating oil compositions which contain a major proportion of a mineral lubricating oil, a minor proportion of an organic phosphite such as triphenyl phosphite, and a small amount, sufficient to bring about substantial stability of the phosphorous compound, of an oil-soluble organic amine.

U.S. Pat. No. 4,634,543 relates to a fluid composition for use in a shock absorber. The fluid composition comprises a lubricating base oil, a boron-containing compound, and a phosphoric acid ester and/or phosphorous acid ester, such as diphenyl hydrogenphosphite.

U.S. Pat. No. 3,645,886 relates to the concept of reducing or preventing the fouling of process equipment in petroleum or chemical industries wherein an organic feed stock is subjected to heat exchange at a temperature of from about 200° to about 1300° F., and there is added to that organic feed stock a mixture of a fatty acid ester of an alkanol amine and a mono-, di-, or triorganic phosphite ester. The triorganic phosphite esters may include triphenyl phosphite.

U.S. Pat. No. 3,484,375 discloses the production of additives for lubricating oils, middle distillate fuels, residual fuels or reduced crudes in order to improve their resistance to oxidation, sludge formation, to improve their viscosity index, or to improve their flow-ability and pour point characteristics. The additives are prepared by reacting an organic phosphite ester with an alkaline polyamine or aminoalcohol. The preferred organic phosphite esters contain at least one hydroxyl group attached to the phosphorous, but they may include triphenyl phosphite.

U.S. Pat. No. 4,170,560 discloses additive compositions for use in crankcase lubricating oils comprising a mixture of an oil soluble anti-oxidant and an oil soluble hydroxylamine which includes both the Ethomeens and the Ethoduomeens. (Sold by the Armak Company, part of Akzona, Inc.).

U.S. Pat. No. 4,529,528 discloses the reaction product of, for example, an Ethomeen, a dialkyl phosphite and a boron compound.

U.S. Pat. No. 4,382,006 discloses a lubricating composition containing a friction reducing portion of a borated adduct of compounds which include the Ethomeens.

U.S. Pat. No. 2,917,160 discloses the use of certain hydroxylated tertiary amines which include the Ethomeens, as a corrosion inhibiting surface active lubricant for metal working. The amines may be used in the form of a salt. Phosphoric acid salts are illustrated.

U.S. Pat. No. 3,186,946 discloses cutting fluids in which the active lubricating component is a borate salt of a tertiary amine which includes both the Ethomeens and the Ethoduomeens.

U.S. Pat. No. 4,557,845 discloses the reaction product of an Ethomeen and a di-($C_1$–$C_6$ hydrocarbyl) phosphite. The reaction product is formed at a temperature between about 80° and 280° C., and in reactant proportions suc that from about 5 to 100% of the amine hydroxy groups are reacted with the phosphite.

U.S. Pat. No. 3,509,052 relates to lubricating compositions containing a lubricating oil, a dispersant which is a derivative of a substituted succinic acid, and a demulsifier. The demulsifier may comprise, for example, an Ethomeen, but the preferred demulsifiers are polyoxyalkylene polyols and derivatives thereof.

U.S. Pat. No. 3,394,179 discloses an oil soluble lubricant additive which is the reaction product of a phosphosulfurized hydrocarbon and an amide which is formed by reacting an aliphatic polyamine with a high molecular weig monocarboxylic acid. The phosphosulfurized hydrocarbon is prepared by reacting a terpene, a petroleum fraction or a polymer of a $C_2$–$C_6$ olefin with a sulfide of phosphorous.

U.S. Pat. No. 2,805,217, relates to condensation products of terpenes with phosphorous sesquisulfide and oxygen. The condensation products are employed in lubricating oil compositions as anti-oxidants and detergents.

U.S. Pat. No. 3,511,780 relates to an additive that is useful as a sludge dispersant, anti-wear agent, anti-oxidant and inhibitor of harmful deposit formation in hydrocarbon compositions including fuel oils and lubricants. The additive is prepared by condensing an alkenyl succinic anhydride with an aliphatic polyamine or with an aliphatic polyamine and a carboxylic acid, followed by further reaction of the condensation product with a phosphosulfurized hydrocarbon and with a dialkyl dithiophosphoric acid. A suitable phosphosulfurized hydrocarbon is exemplified by $P_2S_5$ -treated polyisobutylene.

U.S. Pat. No. 3,850,822 discloses a lubricating oil for an internal combustion engine comprising a major portion of oil and a minor portion of an additive package which includes a dispersant, a phosphosulfurized olefinic hydrocarbon, and a phosphorothionyl disulfide of phenol or of a $C_1$–$C_{18}$ alkyl phenol. In one embodiment, the dispersant is made by the reaction of a polyisobutenyl succinic anhydride with a tetraethylene pentamine, the phosphosulfurized olefinic hydrocarbon is made from the reaction of $P_2S_5$ with alpha-pinene, and the phosphorothionyl disulfide is that of a nonyl phenol.

U.S. Pat. No. 4,557,845 discloses that the products of reaction between a 2-hydroxyethyl alkylamine or certain higher oxylated members, and a dihydrocarbyl phosphite compound are effective friction modifiers and fuel reducing additives for internal combustion engines when such products are compounded with lubricants and liquid fulls. A similar disclosure is contained in U.S. Pat. No. 4,529,528, except that the products are prepared by reacting a bis(2-hydroxyethyl) alkylamine, a dihydrocarbyl phosphite and a boron compound.

U.S. Pat. No. 3,175,976 relates to automatic transmission fluids of improved high temperature stability. The fluids contain a light oil in combination with a di(tertiary-butyl) phenol, a zinc dialkyl dithiophosphate and an alkyl methacrylatevinyl pyrrolidone copolymer.

U.S. Pat. No. 3,933,659 relates to extended life functional fluids which are useful in automatic transmissions. The functional fluids of this patent comprise a major amount of an oil of lubricating viscosity and an effective amount of an alkenyl succinimide, a Group II metal salt of a dihydrocarbyl dithiophosphoric acid, a basic sulfurized alkaline earth metal alkyl phenate, and a compound selected from the group consisting of (a) fatty acid esters of dihydric and other polyhydric alcohols, and oil soluble oxyalkylated derivatives thereof, (b) fatty acid amides of low molecular weight amino acids, (c) N-fatty alkyl-N,N-diethanol amines, (d) N-fatty alkyl-N,N-di(ethoxyethanol) amines, (e) N-fatty alkyl-N,N-di(polyethoxy) ethanol amines, and (f) mixtures thereof.

U.S. Pat. No. 4,010,106 relates to a functional fluid which is useful in automatic transmissions and which comprises an oil of lubricating viscosity, and an effective amount of each of the following: an alkenyl succinimide, a Group II metal salt of a dihydrocarbyl dithiophosphoric acid, a friction modifier, a basic sulfurized alkaline earth metal alkyl phenate, and a chlorinated olefin containing from about 15 to 50 carbon atoms, from 20 to 60% by weight chlorine, and having a boiling point of at least about 300° F. Among the friction modifiers which may be used in the functional fluid there are mentioned fatty acid esters of a polyhdryic alcohol or oil soluble oxyalkylated derivatives thereof, fatty acid amides of low-molecular weight amino acids, N-fatty alkyl-N,N-diethanol amine, N-fatty alkyl-N,N-di(ethoxyethanol)amines, N-fatty alkyl-N,N-di(polyethoxy) ethanol amines or mixtures thereof.

U.S. Pat. No. 4,208,293 discloses lubricating oil compositions adapted for use as a crankcase lubricant in internal combustion engines containing a friction reducing amount of a fatty acid amide or ester of diethanolamine. The compositions show improved results when they contain a zinc dihydrocarbyl dithiophosphate. Other additives may be included in the compositions, and among the additives which are mentioned in this patent are alkaline earth metal phenates and sulfurized phenates, alkaline earth hydrocarbyl sulfonates, phosphosulfurized terpene and polyolefins and their alkaline earth metal salts, poly-alkyl methacrylate or ethylene-propylene copolymers, ethylene-propylene non-conjugated diene terpolymers, and 4,4'-methylenebis(2,6-di-tert-butylphenol).

U.S. Pat. No. 4,474,674 discloses the use of diethanolamides or diisopropanolamides of alkyl thioglycolic acids or boron, phosphorous or metal reaction products thereof as multifunctional additives for power transmission shift fluids such as automatic transmission fluids. These additives provide the properties of anti-oxidation, $H_2S$ suppression, corrosion inhibition and friction modification.

U.S. Pat. No. 2,806,022 discloses neutralizing the reaction products of a phosphorus sulfide and hydrocarbon with a basic metal compound. The neutralized products are used as lubricating additives in the preparation of lubricants for internal combustion engines.

U.S. Patent 2,316,080 relates to lubricants for use in internal combustion engines such as automobile and diesel engines under severe conditions wherein corrosion, piston ring sticking, cylinder wear, and carbon and/or varnish formation may be encountered. The lubricants comprise a lubricating oil and a small amount of a neutralized or partially neutralized reaction product of a phosphorus sulfide and a mono-olefinic hydrocarbon polymer. This neutralized or partially neutralized product, or a metal derivative thereof, may be used in lubricating oils alone or in combination with the non-neutralized phosphorus sulfide-olefin polymer reaction product. The neutralization of phosphorus sulfide-olefin polymer reaction product may be effected by adding to the reaction product a suitable alkaline compound such as a hydroxide, a carbonate or an oxide of an alkali or alkaline earth metal, and preferably potassium hydroxide. Ammonia or alkyl or aryl substituted ammonia such a amines may be used. Similar disclosures are contained in U.S. Pat. Nos. 2,316,082 and 2,316,088.

U.S. Pat. No. 3,034,907 discloses compositions of matter which are effective agents for hindering or retarding rust formation on iron surfaces and ice formation in the intake system of internal combustion engines. The compositions are characterized by a content of (a) a hydrophobic organic carrier, (b) a carboxylic acid amide monocarboxylic acid and (c) and an at least equivalent amount of a hydroxyalkylated nitrogen base which contains at least one lipophilic radical. The hydroxyalkylated nitrogen base corresponds to the general formula:

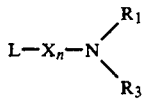

wherein L represents a lipophilic radical defined above, X represents a bridging member which is bound to the nitrogen atom by means of an aliphatic carbon atom and which is selected from the group consisting of lower —O-alkylene, —S-alkylene, —O-hydroxyalkylene, —S-hydroxyalkylene, and

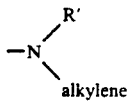

wherein R'=H, low molecular alkyl or low molecular hydroxyalkyl, —CO—O—alkylene and —CO—O—hydroxyalkylene radicals. In the above formulas, n represents the integer 0 or 1, $R_1$ represents hydrogen, a lower alkyl or lower hydroxyalkyl or lower aminoalkyl radical, and $R_2$ is the same as $(L\text{-}X_n)$ and $R_1$. In all cases, at least one of the radicals X, $R_1$ and $R_2$ is a lower hydroxyalkylated aliphatic radical.

U.S. Pat. No. 3,235,501 relates to oil compositions which contain a detergent which promotes foaming, a silicone polymer anti-foamant and a small amount of a foam inhibiting polyalkyl oxylated aliphatic amine. The polyalkyl oxylated aliphatic amines conform to one of the following formulas "a" or "b" depending on whether the amine from which they are prepared is a mono- or diamine:

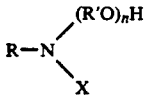

"a"

where R is an aliphatic radical of from about 4 to 24 carbon atoms, —R'O— is an alkylene oxide radical selected from the group consisting of ethylene oxide and propylene oxide radicals, n is an integer from 1 to about 25 and X is selected from hydrogen, R and $—(R'O)_2H$ radicals, the total value of n in any instance being no greater than 25, and

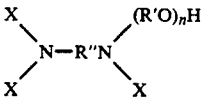

"b"

where R" is an aliphatic radical having from 2 to about 6 carbon atoms, R'O, n and X are defined in Formula "a" but at least one X is an R radical, and the total value of n in any instance being no greater than about 25. Among the detergents which are disclosed in the patent are the oil soluble metal salts of high molecular weight (300–1000) sulfonic acids, such as petroleum derived sulfonic acids and synthetic alkyl-aryl sulfonic acids having from about 8 to about 24 carbon atoms in the alkyl portion thereof, the normal or basic (complex or over-based) barium and calcium sulfonate salts, the metal salts of alkylphenol sulfides, such as, for example, the normal or basic (complex) barium and calcium salts of amyl and nonyl-substituted phenol sulfides, and the metal salts of phosphorous sulfide-hydrocarbon reaction products. Specific salts of this character are the metal salts of phosphosulfurized polyolefins, such as the barium salts of $P_2S_5$-polypropylene reaction products. Salts of this type are fully described for example the above-discussed U.S. Pat. Nos. 2,316,080, 2,316,082, 2,316,088 and 2,806,022.

U.S. Pat. No. 4,664,826 relates to metal salt esters of hydrocarbyl-substituted succinic acid or anhyride, such as octadecenyl succinic anhydride, and alkanols, such as thio-bis-ethanol, which are capable of exhibiting friction modification, oxidation inhibition, and corrosion inhibition properties in power transmitting fluids such as automatic transmission fluids.

U.S. Pat. No. 4,704,217 relates to a gasoline crankcase lubricant which contains as a friction modifier a dialkoxylated alkyl polyoxyalkyl amine of the formula:

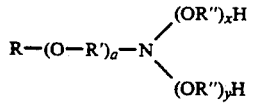

wherein R is a ($C_1$–$C_{20}$) hydrocarbyl radical, R′ and R″ are divalent ($C_1$–$C_{10}$) alkylene groups, a is an integer of about 1 to about 10, and x+y is a value of about 1 to about 20.

SUMMARY OF THE INVENTION

The present invention is based in part on the discovery that a certain hydroxy ether amine compounds possess friction modification properties and that they are compatible with other conventional additives. The hydroxy ether amine friction modifiers of this invention are stable, and hence do not adversely affect friction stability of fuels and lubricants in which they are contained. In short, the hydroxy ether amine friction modifiers of this invention have been found to be a desirable additive for use in oleaginous compositions, particularly power transmission fluids, and more particularly automatic transmission fluids.

In one aspect of the present invention, there is provided a hydroxy ether amine compound friction modifier which is characterized by the formula:

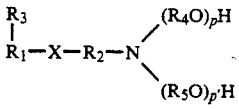

I wherein $R_1$ represents a $C_3$–$C_{27}$ saturated or unsaturated aliphatic hydrocarbon radical; $R_2$ represents a straight or branched chain $C_1$–$C_6$ alkylene radical; $R_3$ represents H or $CH_3$; $R_4$ and $R_5$, independently, represent the same or different straight or branched chain alkylene radical (preferably straight chain alkylene) typically about $C_2$ to about $C_5$, and preferably $C_2$ alkylene; p and p′, independently, represent 1-4, preferably 1-3 (e.g., 1); X represents O or S; and wherein it is preferred that there are a total of from about 10 to about 30 carbon atoms in the compound.

The above hydroxy ether amine additive, when combined with other conventional additives, is particularly suited to meeting the stringent ATF requirements from the standpoint of the proper balance of anti-wear, static and dynamic friction coefficients, friction modification and stability, dispersancy, sludge inhibition, anti-oxidation and corrosion resistance properties.

In another aspect of the invention, the above-described hydroxy ether amine friction modifier compounds may be employed in combination with a triaryl phosphite anti-wear material such as triphenyl phosphite.

In another aspect of the invention, the hydroxy ether amine friction modifier compounds may be employed in the form of a borated reaction product of the hydroxy ether amine compound with a boron compound such as boric acid or a $C_1$–$C_4$ trialkyl borate.

In another aspect of the present invention, there is provided an oleaginous composition comprising an oleaginous material selected from the group consisting of fuels and lubricating oil, together with at least one of the above-described borated or non-borated hydroxy ether amine friction modifier compounds.

In a still further embodiment of the present invention, there is provided a lubricating oil composition adaptable for use as an automatic transmission fluid comprising at least one of the above-described hydroxy ether amine friction modifier additvies.

In another embodiment of the present invention, there is provided a lubricating oil composition adaptable for use as a power transmitting fluid which comprises a lubricating oil having dissolved or dispersed therein at least one of the herein-described hydroxy ether amine compounds.

In yet another embodiment there is provided a lubricating oil composition adaptable for use as a power transmitting fluid which comprises a lubricating oil having dissolved or dispersed therein at least one of the herein-described hydroxy ether amine compounds and a triarylphosphite anti-wear additive.

In another embodiment of the present invention there is provided a process for improving the static and dynamic friction coefficients and the frictional stability properties of a lubricating oil composition which is adapted for use as a power transmitting fluid which comprises adding to said lubricating oil composition at least one of the hydroxy ether amine compounds disclosed herein.

DESCRIPTION OF PREFERRED EMBODIMENTS

The hydroxy ether amine friction modifer additives of the present invention can be represented by the structural formula:

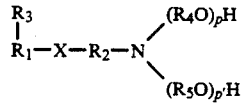

I where $R_1$ represents a straight or branched chain, saturated or unsaturated, aliphatic hydrocarbon radical (preferably straight chain alkylene), typically about $C_3$ to about $C_{27}$, preferably about $C_{10}$ to about $C_{20}$, and most preferably about $C_{16}$ to $C_{18}$ alkylene; $R_2$ represents a straight or branched chain alkylene radical (preferably straight alkylene), typically $C_2$ to about $C_6$, preferably about $C_2$ to about $C_4$, and most preferably $C_3$ alkylene; $R_3$ represents H or $CH_3$, preferably H; $R_4$ and $R_5$, which may be the same or different, independently can represent a straight or branched chain alkylene radical (preferably straight chain alkylene), typically about $C_2$ to about $C_5$, and preferably $C_2$ alkylene; and p and p′, independently, represent 1–4, preferably 1–3; and X represents O or S, preferably O. In a particularly preferred embodiment, X represents O, $R_1$ and $R_3$ contain a combined total of 18 carbon atoms, $R_2$ represents $C_3$ alkylene, and $R_4$ and $R_5$ are each $C_2$ alkylene. In all cases, it is preferred that the hydroxy ether amine compounds contain a combined total of from about 10 to about 30 carbon atoms.

When X is O, the hydroxy ether amine compounds can be prepared, for example, by a multi-step process wherein an alkanol is first reacted, in the presence of an initiator, with an unsaturated nitrile such as acrylonitrile to form an ether nitrile intermediate. The intermediate is then hydrogenated, preferably in the presence of a conventional hydrogenation catalyst such as Raney nickel to form an ether amine. The ether amine is then reacted with an alkylene oxide, such as ethylene oxide in the presence of an alkaline catalyst by a conventional method at a temperature in the range of about 90°-150° C. The overall process for preparing the desired hydroxy ether amine compounds is described, for example, in U.S. Pat. No. 3,255,253 and can be illustrated by the following equations:

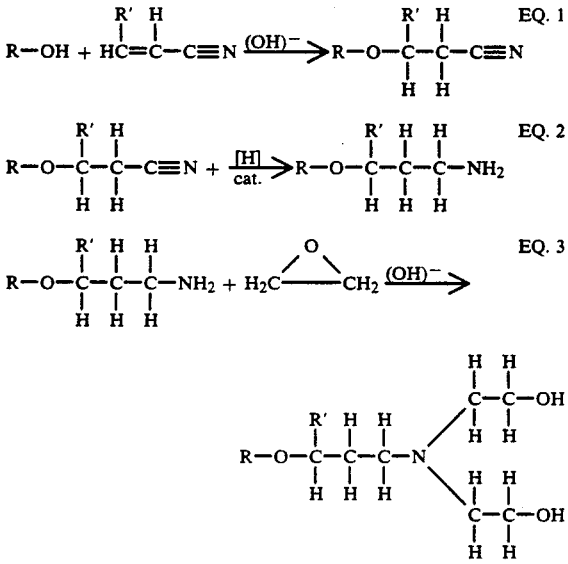

EQ. 1

EQ. 2

EQ. 3 where R and R' represent straight or branched chain alkyl radicals.

When X is S, the hydroxy ether amine friction modifying compounds can be formed, for example, by effecting a conventional free radical reaction between a long chain alpha-olefin with a hydroxyalkyl mercaptan, such as beta-hydroxyethyl mercaptan, to produce a long chain alkyl hydroxyalkyl sulfide. The long chain alkyl hydroxyalkyl sulfide is then mixed with thionyl chloride at a low temperature and thereafter heated to about 40° C. to form a long chain alkyl chloroalkyl sulfide. The long chain alkyl chloroalkyl sulfide is then caused to react with a dialkanolamine, such as diethanolamine, and, if desired, with an alkylene oxide, such as ethylene oxide, in the presence of an alkaline catalyst and at a temperature on the order of about 100° C. to form the desired hydroxy ether amine compounds. Processes of the above type are known in the art and are discussed, for example, in U.S. Pat. No. 3,705,139, the disclosure of which is incorporated herein by reference.

The hydroxy ether amine compounds may be used as such. However they may also be used in the form of an adduct or reaction product with a boron compound, such as boric oxide and the metaborates, boric acid, or a mono-, di-, or trihydrocarbyl, e.g. trialkyl, borate.

Such adducts or derivatives may be illustrated, for example, by the following structural formula:

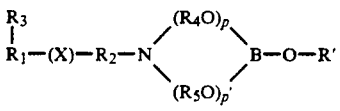

II wherein $R_1$, $R_2$, $R_3$, $R_4$, $R_5$, p, and p' are the same as defined above, and wherein R' is either H or an alkyl radical.

Representative examples of alkyl borates which may be used to borate the alkanol amine compounds include mono-, di-, and tributyl borates, mono-, di-, and trihexyl borates, and the like. The borated adducts may be prepared simply by heating a mixture of the hydroxy ether amine compound and the boron compound, preferably in the presence of a suitable solvent or solvents, at a temperature on the order of about 100° C. to about 280° C. over a period of from about 1-2 hours up to about 15 hours. Boration levels can vary widely, for example, over a range of from about 1.0 to about 5.0 wt. %. Such boration procedures are well known in the art and are described, for example, in U.S. Pat. Nos. 4,529,528, 4,594,171, and 4,382,006, the disclosures of which are incorporated herein by reference.

As indicated above, the hydroxy ether amine friction modifers of this invention are particularly suitable for use in oleaginous compositions which also contain organic phosphite ester as an anti-wear additive. The organic phosphite esters which may be used can be characterized by the formula:

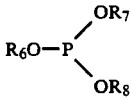

III wherein $R_6$ is a hydrocarbyl radical selected from the group consisting of aryl and $C_1$-$C_3$ alkaryl, and R7 and $R_8$ may be the same or different hydrocarbyl radical selected from the group consisting of $C_1$-$C_{25}$, preferably $C_6$-$C_{20}$, and most preferably $C_8$-$C_{18}$ alkyl, $C_1$-$C_3$ alkaryl, $C_5$-$C_8$ cycloalkyl, aryl, and halo-substituted derivatives thereof.

Representative examples of suitable $R_6$, $R_7$ and $R_8$ groups of formula III include octyl, nonyl, decyl, dodecyl, hexyl, octadecyl, and phenyl, with the phenyl group being preferred.

In most cases it is preferred the $R_6$, $R_7$ and $R_8$ are the same.

The organic phosphite esters can be obtained by the direct esterification of phosphorous acid or a phosphorous trihalide with a phenol or an alcohol or a mixture thereof. The methods for preparing the organic phosphite esters are known in the art and are discussed, for example, in U.S. Pat. No. 3,513,093, the disclosure of which is incorporated herein by reference.

The combination of the organic phosphite esters and the hydroxy ether amine compounds of the present invention has been found to possess multifunctional properties including anti-wear, friction modification, friction stability, and copper corrosion resistance properties.

Accordingly, the hydroxy ether amine friction modifier compounds, preferably in combination with the organic phosphite ester compounds, are used by incorporation and dissolution or dispersion into an oleaginous material such as fuels and lubricating oils, and particularly in power transmitting fluids such as automatic transmission fluids.

When the hydroxy ether amine compounds, or the combination of the organic phosphite ester compounds and the hydoxy ether amine compounds of this invention are used in normally liquid petroleum fuels such as middle distillates boiling from about 150o to 800° F., including kerosene, diesel fuels, home heating fuel oil, jet fuels, etc., a concentration of the organic phosphite additive in the fuel in the range of typically from about 0.1 to about 1, preferably 0.2 to about 0.8, and most preferably 0.3 to about 0.6 wt. % of the total composition, usually will be employed. Likewise, a concentration of the hydroxy ether amine compound additive in the range of typically from about 0.05 to about 5, preferably 0.08 to about 1 and most preferably 0.1 to about 0.5,weight %, based on the total weight of the composition, will be employed.

However, the present combination of additives finds its primary utility in lubricating oil compositions which employ a base oil in which the additive or additives are dissolved or dispersed.

Such base oils may be natural or synthetic although the natural base oils will derive a greater benefit.

Thus, base oils suitable for use in preparing lubricating compositions of the present invention include those conventionally employed as crankcase lubricating oils for spark-ignited and compression-ignited internal combustion engines, such as automobile and truck engines, marine and railroad diesel engines, and the like. Particularly advantageous results are achieved by employing the additive combination of the present invention in base oils conventionally employed in power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

Thus, the additives of the present invention suitably may be incorporated into synthetic base oils such as alkyl esters of dicarboxylic acids, polyglycols and alcohols; polyalphaolefins, alkyl benzenes, organic esters of phosphoric acids, polysilicone oil, etc.

Natural base oils include mineral lubricating oils which may vary widely as to their crude source, e.g. whether paraffinic, naphthenic, mixed paraffinic-naphthenic, and the like; as well as to their formation, e.g. distillation range, straight run or cracked, hydrofined, solvent extracted and the like.

More specifically, the natural lubricating oil base stocks which can be used in the compositions of this invention may be straight mineral lubricating oil or distillates derived from paraffinic, naphthenic, asphaltic, or mixed base crudes, or, if desired, various blended oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents such as phenol, sulfur dioxide, furfural, dichlorodiethyl ether, nitrobenzene, crotonaldehyde, etc.

The lubricating oil base stock conveniently has a viscosity of typically about 2.5 to about 12, and preferably about 3.5 to about 9 cst. at 100° C.

The additives of the present invention can be employed in a lubricating oil composition which comprises lubricating oil, typically in a major amount, and the additives, typically in a minor amount, which is effective to impart enhanced friction modification, antiwear, and friction stability properties relative to the absence of the additives. Additional conventional additives selected to meet the particular requirements of a selected type of lubricating oil composition can be included as desired.

The additive materials of this invention are oil soluble, dissolvable in oil with the aid of a suitable solvent, or are stably dispersible in oil. Oil soluble, dissolvable, or stably dispersible, as that terminology is used herein, does not necessarily indicate that the materials are soluble, dissolvable, miscible, or capable of being suspended in oil in all proportions. It does mean, however, that the respective additives are soluble or stably dispersible in oil to an extent sufficient to exert their intended effect in the environment in which the oil is employed. Moreover, the incorporation of an additional dispersant and/or other additives may also permit incorporation of higher levels of a particular organic phosphite ester, or hydroxy ether amine compound, if desired.

The additives of the present invention can be incorporated into the lubricating oil in any convenient way. Thus, they can be added directly to the oil by dispersing, or dissolving the same in the oil at the desired level of concentration typically with the aid of the suitable solvent such as mineral oil. Such blending can occur at room temperature or elevated temperatures. Alternatively, the organic phosphite ester and hydroxy ether amine additive combination may be blended with a suitable oil soluble solvent and base oil to form a concentrate, followed by blending the concentrate with lubricating oil base stock to obtain the final formulation.

The lubricating oil base stock for the additives of the present invention typically is adapted to perform a selected function by the incorporation of additives therein to form lubricating oil compositions (i.e., formulations).

As indicated above, one broad class of lubricating oil compositions suitable for use in conjunction with the additives of the present invention are power steering fluids, tractor fluids, tractor universal oils, and the like.

The benefits of the additives of the present invention are particularly significant when employed in a lubricating oil adapted for use as an automatic transmission fluid.

Power transmitting fluids, such as automatic transmission fluids, as well as lubricating oils in general, are typically compounded from a number of additives each useful for improving chemical and/or physical properties of the same. The additives are usually sold as a concentrate package in which mineral oil or some other base oil is present. The mineral lubricating oil in automatic transmission fluids typically is refined hydrocarbon oil or a mixture of refined hydrocarbon oils selected according to the viscosity requirements of the particular fluid, but typically would have a viscosit range of 2.5–9, e.g. 3.5–9 cst. at 100° C. Suitable base oils include a wide variety of light hydrocarbon mineral oils, such as naphthenic base oils, paraffin base oils, and mixtures thereof.

Representative additives typically present in such packages as well as in the final formulation include viscosity index (V.I.) improvers, corrosion inhibitors, oxidation inhibitors, friction agents, lube oil flow improvers, dispersants, anti-foamants, anti-wear agents, detergents, metal rust inhibitors and seal swellants.

Viscosity modifiers impart high and low temperature operability to the lubricating oil and permit it to remain shear stable at elevated temperatures and also exhibit acceptable viscosity or fluidity at low temperatures.

V.I. improvers are generally high molecular weight hydrocarbon polymers or more preferably polyesters. The V.I. improvers may also be derivatized to include other properties or functions, such as the addition of dispersancy properties.

These oil soluble V.I. polymers will generally have number average molecular weights of from $10^3$ to $10^6$, preferably $10^4$ to $10^6$, e.g. 20,000 to 250,000, as determined by gel permeation chromatography or membrane osmometry.

Examples of suitable hydrocarbon polymers include homopolymers and copolymers of two or more monomers of $C_2$ to $C_{30}$, e.g. $C_2$ to $C_8$ olefins, including both alpha-olefins and internal olefins, which may be straight or branched, aliphatic, aromatic, alkyl-aromatic, cycloaliphatic, etc. Frequently they will be copolymers of ethylene with $C_3$ to $C_{30}$ olefins, particularly preferred being the copolymers of ethylene and propylene. Other polymers can be used such as polyisobutylenes, homopolymers and copolymers of $C_6$ and higher alpha-olefins, atactic polypropylene, hydrogenated polymers and copolymers and terpolymers of styrene, e.g. with isoprene and/or butadiene.

More specifically, other hydrocarbon polymers suitable as viscosity index improvers in the present invention include those which may be described as hydrogenated or partially hydrogenated homopolymers, and random, tapered, star, or block interpolymers (including terpolymers, tetrapolymers, etc.) of conjugated dienes and/or monovinyl aromatic compounds with, optionally, alpha-olefins or lower alkenes, e.g., $C_3$ to $C_{18}$ alpha-olefins or lower alkenes. The conjugated dienes include isoprene, butadiene, 2,3-dimethylbutadiene, piperylene and/or mixtures thereof, such as mixtures of isoprene and butadiene. The monovinyl aromatic compounds include vinyl di- or polyaromatic compounds, e.g., vinyl naphthalene, or mixtures of vinyl mono-, di- and/or polyaromatic compounds, but are preferably monovinyl monoaromatic compounds, such as styrene or alkylated styrenes substituted at the alpha-carbon atoms of the styrene, such as alpha-methylstyrene, or at ring carbons, such as o-, m-, p-methylstyrene, ethylstyrene, propylstyrene, isopropylstyrene, butylstyrene isobutylstyrene, tert-butylstyrene (e.g., p-tert-butylstyrene). Also included are vinylxylenes, methylethylstyrenes and ethylvinylstyrenes. Alpha-olefins and lower alkenes optionally included in these random, tapered and block copolymers preferably include ethylene, propylene, butene, ethylene-propylene copolymers, isobutylene, and polymers and copolymers thereof. As is also known in the art, these random, tapered and block copolymers may include relatively small amounts, that is less than about 5 mole %, of other copolymerizable monomers such as vinyl pyridines, vinyl lactams, methacrylates, vinyl chloride, vinylidene chloride, vinyl acetate, vinyl stearate, and the like.

Specific examples include random polymers of butadiene and/or isoprene and polymers of isoprene and/or butadiene and styrene. Typical block copolymers include polystyrene-polyisoprene, polystyrene-polybutadiene, polystyrene-polyethylene, polystyrene-ethylene propylene copolymer, polyvinyl cyclohexane-hydrogenated polyisoprene, and polyvinyl cyclohexane-hydrogenated polybutadiene. Tapered polymers include those of the foregoing monomers prepared by methods known in the art. Star-shaped polymers typically comprise a nucleus and polymeric arms linked to said nucleus, the arms being comprised of homopolymer or interpolymer of said conjugated diene and/or monovinyl aromatic monomers. Typically, at least about 80% of the aliphatic unsaturation and about 20% of the aromatic unsaturation of the star-shaped polymer is reduced by hydrogenation.

Representative examples of patents which disclose such hydrogenated polymers or interpolymers include U.S. Pat. Nos. 3,312,621, 3,318,813, 3,630,905, 3,668,125, 3,763,044, 3,795,615, 3,835,053, 3,838,049, 3,965,019, 4,358,565, and 4,557,849, the disclosures of which are herein incorporated by reference.

The polymer may be degraded in molecular weight, f.r example by mastication, extrusion, oxidation or thermal degradation, and it may be oxidized and contain oxygen. Also included are derivatized polymers such as post-grafted interpolymers of ethylene-propylene with an active monomer such as maleic anhydride which may be further reacted with an alcohol, or amine, e.g. an alkylene polyamine or hydroxy amine, e.g. see U.S. Pat. Nos. 4,089,794, 4,160,739, 4,137,185, or copolymers of ethylene and propylene reacted or grafted with nitrogen compounds such as shown in U.S. Pat. Nos. 4,068,056, 4,068,058, 4,146,489 and 4,149,984.

Suitable hydrocarbon polymers are ethylene copolymers containing from 15 to 90 wt. % ethylene, preferably 30 to 80 wt. % of ethylene and 10 to 85 wt. % preferably 20 to 70 wt. % of one or more $C_3$ to $C_{28}$, preferably $C_3$ to $C_{18}$, more preferably $C_3$ to $C_8$, alpha-olefins. While not essential, such copolymers preferably have a degree of crystallinity of less than 25 wt. %, as determined by X-ray and differential scanning calorimetry. Copolymers of ethylene and propylene are most preferred. Other alpha-olefins suitable in place of propylene to form the copolymer, or to be used in combination with ethylene and propylene, to form a terpolymer, tetrapolymer, etc., include 1-butene, 1-pentene, 1-hexene, 1-heptene, 1-octene, 1-nonene, 1-decene, etc.; also branched chain alpha-olefins, such as 4-methyl-1-pentene, 4-methyl-1-hexene, 5-methylpentene-1, 4,4-dimethyl-1-pentene, and 6-methyl-heptene-1, etc., and mixtures thereof.

Terpolymers, tetrapolymers, etc., of ethylene, said $C_{3-28}$ alpha-olefin, and non-conjugated diolefin or mixtures of such diolefins may also be used. The amount of the non-conjugated diolefin generally ranges from about 0.5 to 20 mole percent, preferably from about 1 to about 7 mole percent, based on the total amount of ethylene and alpha-olefin present.

The preferred V.I. improvers are polyesters, most preferably polyesters of ethylencially unsaturated $C_3$ to $C_8$ mono- and dicarboxylic acids such as methacrylic and acrylic acids, maleic acid, maleic anhydride, fumaric acid, etc.

Examples of unsaturated esters that may be used include those of aliphatic saturated mono alcohols of at least 1 carbon atom and preferably of from 12 to 20 carbon atoms, such as decyl acrylate, lauryl methacrylate, cetyl methacrylate, stearyl methacrylate, and the like and mixtures thereof.

Other esters include the vinyl alcohol esters of $C_2$ to $C_{22}$ fatty or monocarboxylic acids, preferably saturated such as vinyl acetate, vinyl laurate, vinyl palmitate, vinyl stearate, vinyl oleate, and the like and mixtures thereof. Copolymers of vinyl alcohol esters with unsaturated acid esters such as the copolymer of vinyl acetate with dialkyl fumarates, can also be used.

The esters may be copolymerized with still other unsaturated monomers such as olefins, e.g. 0.2 to 5 moles of $C_2$–$C_{20}$ aliphatic or aromatic olefin per mole of unsaturated ester, or per mole of unsaturated acid or anhydride followed by esterification. For example, copolymers of styrene with maleic anhydride esterified with alcohols and amines are known, e.g. see U.S. Pat. No. 3,702,300.

Such ester polymers may be grafted with, or the ester copolymerized with, polymerizable unsaturated nitrogen-containing monomers to impart dispersancy to the V.I. improvers. Examples of suitable unsaturated nitrogen-containing monomers to impart dispersancy include those containing 4 to 20 carbon atoms such as amino substituted olefins as p-(betadiethylaminoethyl)styrene; basic nitrogen-containing heterocycles carrying a polymerizable ethylenically unsaturated substituent, e.g. the vinyl pyridines and the vinyl alkyl pyridines such as 2-vinyl-5-ethyl pyridine, 2-meth. -5-vinyl pyridine, 2-vinyl-pyridine, 3-vinyl-pyridine, 4-vinyl-pyridine, 3-methyl-5-vinyl-pyridine, 4-methyl-2-vinyl-pyridine, 4-ethyl-2-vinyl-pyridine and 2-butyl-5-vinyl-pyridine and the like.

N-vinyl lactams are also suitable, e.g. N-vinyl pyrrolidones or N-vinyl piperidones.

The vinyl pyrrolidones are preferred and are exemplified by N-vinyl pyrrolidone, N-(1-methyl-vinyl) pyrrolidone, N-vinyl-5-methyl pyrrolidone, N-vinyl-3,3-dimethylpyrrolidone, N-vinyl-5-ethyl pyrrolidone, etc.

Corrosion inhibitors, also known as anti-corrosive agents, reduce the degradation of the non-ferrous metallic parts in contact with the fluid. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioether, and also preferably in the presence of carbon dioxide. As discussed hereinabove, the phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 weight percent of a sulfide of phosphorous for ½ to 15 hours, at a temperature in the range of 150° to 400° F. Neutralization of the phosphosulfurized hydrocarbon may be effected in the manner taught in U.S. Pat. No. 2,969,324.

Other suitable corrosion inhibitors include copper corrosion inhibitors comprising hydrocarbylthio-disubstituted derivatives of 1, 3, 4-thiadiazole, e.g. $C_2$ to $C_{30}$; alkyl, aryl, cycloalkyl, aralkyl and alkaryl, mono-, di-, tri- or tetra- or thio disubstituted derivatives thereof.

Representative examples of such material included 2,5-bis(octylthio)-1,3,4-thiadiazole; 2,5-bis(octyldithio)-1,3,4-thiadiazole; 2,5-bis(octyltrithio)-1,3,4-thiadiazole; 2,5-bis(octyltetrathio)-1,3,4-thiadiazole; 2,5-bis(nonylthio)-1,3,4-thiadiazole; 2,5-bis(dodecyldithio)-1,3,4-thiadiazole; 2,5-bis(cyclohexyldithio)-1,3,4-thiadiazole; 2-dodecyldithio-5-phenyldithio-1,3,4-thiadiazole; and mixtures thereof.

Preferred copper corrosion inhibitors are the derivatives of 1,3,4-thiadiazoles such as those described in U.S. Pat. Nos. 2,719,125, 2,719,126, and 3,087,932; especially preferred is the compound 2,5-bis(t-octyldithio)-1,3,4-thiadiazole commercially available as Amoco 150, and 2, 5-bis(t-nonyldithio)-1,3,4-thiadiazole, commercially available as Amoco 158.

The preparation of such materials is further described in U.S. Pat. Nos. 2,719,125, 2,719,126, 3,087,932, and 4,410,436, the disclosures of which are hereby incorporated by reference Oxidation inhibitors reduce the tendency of mineral oils to deteriorate in service which deterioration is evidenced by the products of oxidation such as sludge and varnish-like deposits on the metal surfaces. Such oxidation inhibitors include alkaline earth metal salts of alkylphenol thioethers having preferably $C_5$ to $C_{12}$ alkyl side chains, e.g. calcium nonylphenol sulfide, barium t-octylphenol sulfide; aryl amines, e.g. dioctylphenylamine, phenyl-alphanaphthylamine; phosphosulfurized or sulfurized hydrocarbons, etc.

Friction modifiers serve to impart the proper friction characteristics to an ATF as required by the automotive industry. In the present invention, the hydroxy ether amine compounds function as the primary friction modifier.

Dispersants maintain oil insolubles, resulting from oxidation during use, in suspension in the fluid thus preventing sludge flocculation and precipitation. Suitable dispersants include, for example, dispersants of the ash-producing or ashless type, the latter type being preferred.

The ash-producing detergents are exemplified by oil soluble neutral and basic salts of alkali or alkaline earth metals with sulfonic acids, carboyxlic acids, or organic phosphorus acids characterized by at least one direct carbon-to-phosphorus linkage such as those prepared by the treatment of an olefin polymer (e.g. polyisobutene having a molecular weight of 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichimetrically larger amouts than the organic acid radical. The commonly employed method for preparing the basic salts involve heating a mineral oil solution of an acid with a stoichiometric excess of a metal neutralizing agent such as the metal oxide, hydroxide, carbonate, bicarbonate, or sulfide at a temperature of about 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, ethylene glycol, stearyl alcohol, and cyclohexyl alcohol; and amines such as aniline, phenylenediamine, phenyl-beta-naphthylamine, and dodecylamine. A particularly effective method for preparing the basic salts comprises mixing an acid with an excess of a basic alkaline earth metal neutralizing agent and a least one alcohol promoter, and carbonating the mixture at an elevated temperature such as 60°-200° C. This class of materials is discussed further hereinabove in connection with detergents and metal rust inhibitors.

The most preferred ash-producing detergents include the metal salts of sulfonic acids, alkyl phenols, sulfurized alkyl phenols, alkyl salicylates, naphthenates and other oil soluble mono- and dicarboxylic acids. Highly basic (viz, overbased) metal salts, such as highly basic alkaline earth metal sulfonates (especially Ca and Mg salts) are frequently used as detergents. They are usually produced by heating a mixture comprising an oil soluble sulfonate or alkaryl sulfonic acid, with an excess of alkaline earth metal compound above that required for complete neutralization of any sulfonic acid present, and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms such as for example haloparaffins, olefins that may be obtained by dehydrogenation of paraffins, polyolefins as for example polymers from ethylene, propylene, etc. The alkaryl sulfonates usually contain from about 9 to about 70 more carbon atoms, preferably from about 16 to about 50 carbon atoms per alkyl substituted aromatic moiety.

The alkaline earth metal compounds with may be used in neutralizing these alkaryl sulfonic acids to provide the sulfonates includes the oxides and hydroxides, alkoxides, carbonates, carboxylate, sulfide, hydrosulfide, nitrate, borates and ethers of magnesium, calcium, and barium. Examples are calcium oxide, calcium hydroxide, magnesium acetate and magnesium borate. As noted, the alkaline earth metal compound is used in excess of that required to complete neutralization of the alkaryl sulfonic acids. Generally, the amount ranges from about 100 to about 220%, although it is preferred to use at least 125%, of the stoichiometric amount of metal required for complete neutralization.

Various other preparations of basic alkaline earth metal alkaryl sulfonates are known, such as those described in U.S. Pat. Nos. 3,150,088 and 3,150,089, wherein overbasing is accomplished by hydrolysis of an alkoxide-carbonate complex with the alkaryl sulfonate in a hydrocarbon solvent/diluent oil.

Ashless dispersants, which are the preferred dispersant for use in connection with this invention, are so called despite the fact that, depending on their constitution, the dispersant may upon combustion yield a nonvolatile material such as boric oxide or phosphorus pentoxide; however, they ordinarily do not contain metal and therefore do not yield a metal-containing ash on combustion. Many types of ashless dispersants are known in the art, and any of them are suitable for use in the lubricant compositions of this invention. The following are illustrative:

1. Reaction products of carboxylic acids (or derivatives thereof) containing at least about 30 and preferably at least about 50 carbon atoms with nitrogen containing compounds such as amine, organic hydroxy compounds such as phenols and alcohols, and/or basic inorganic materials. Examples of these "carboxylic dispersants" are described, for example, in British Patent No. 1,306,529 and in U.S. Pat. Nos. 3,272,746, 3,341,542, 3,454,607 and 4,654,403.

More, specifically, nitrogen- or ester-containing ashless dispersants comprise members selected from the group consisting of oil soluble salts, amides, imides, oxazolines and esters, or mixtures thereof, of long chain hydrocarbyl-substituted mono- and dicarboxylic acids or anhydride or ester derivatives thereof wherein said long chain hydrocarbyl group is a polymer, typically of a $C_2$ to $C_{10}$, e.g., $C_2$ to $C_5$, monoolefin, said polymer having a number average molecular weight of from about 700 to 5000.

The long chain hydrocarbyl-substituted dicarboxylic acid material which can be used to make the dispersant includes the reaction product of long chain hydrocarbon polymer, generally a polyolefin, with (i) monounsaturated $C_4$ to $C_{10}$ dicarboxylic acid wherein (a) the carboxyl groups are vicinyl, (i.e. located on adjacent carbon atoms) and (b) at least one, preferably both, of said adjacent carbon atoms are part of said mono unsaturation; or with (ii) derivatives of (i) such as anhydrides or $C_1$ to $C_5$ alcohol derived mono- or diesters of (i). Upon reaction with the hydrocarbon polymer, the monounsaturation of the dicarboxylic acid material becomes saturated. Thus, for example, maleic anhydride becomes a hydrocarbyl-substituted succinic anhydride.

Typically, from about 0.7 to about 4.0 (e.g., 0.8 to 2.6), preferably from about 1.0 to about 2.0, and most preferably from about 1.1 to about 1.7 moles of said unsaturated $C_4$ to $C_{10}$ dicarboxylic acid material are charged to the reactor per mole of polyolefin charged.

Normally, not all of the polyolefin reacts with the unsaturated acid or derivative and the hydrocarbyl-subsituted dicarboxylic acid material will contain unreacted polyolefin. The unreacted polyolefin is typically not removed from the reaction mixture (because such removal is difficult and would be commercially infeasible) and the product mixture, stripped of any unreacted monounsaturated $C_4$ to $C_{10}$ dicarboxylic acid material, is employed for further reaction with the amine or alcohol as described hereinafter to make the dispersant.

Characterization of the average number of moles of dicarboxylic acid, anydride or ester which have reacted per mole of polyolefin charged to the reaction (whether it has undergone reaction or not) is defined herein as functionality. Said functionality is based upon (i) determination of the saponification number of the resulting product mixture using potassium hydroxide; and (ii) the number average molecular weight of the polymer charged using techniques well known in the art. Functionality is defined solely with reference to the resulting product mixture. Consequently, although the amount of said reacted polyolefin contained in the resulting product mixture can be subsequently modified, i.e., increased or decreased by techniques known in the art, such mocdifications do not alter functionality as defined above. The term hydrocarbyl-substituted dicarboxylic acid material is intended to refer to the product mixture whether it has undergone such modification or not.

Accordingly, the functionality of the hydrocarbyl-substituted dicarboxylic acid material will be typically at least about 0.5, preferably at least about 0.8, and most preferably at least about 0.9, and can vary typically from about 0.5 to about 2.8 (e.g., 0.6 to 2), preferably from about 0.8 to about 1.4, and most preferably from about 0.9 to about 1.3.

Exemplary of such unsaturated mono and dicarboxylic acids, or anhydrides and esters thereof are fumaric acid, itaconic acid, maleic acid, maleic anhydride, chloromaleic acid, chloromaleic anhydride, acrylic acid, methacrylic acid, crotonic acid, cinnamic acid, etc.

Preferred olefin polymers for reaction with the unsaturated dicarboxylic acids or derivatives thereof are polymers comprising a major molar amount of $C_2$ to $C_{10}$, e.g. $C_2$ to $C_5$ monoolefin. Such olefins include ethylene, propylene, butylene, isobutylene, pentene, octene-1, styrene, etc. The polymers can be homopolymers such as polyisobutylene, as well as copolymers of two or more of such olefins such as copolymers of: ethylene and propylene; butylene and isobutylene;

propylene and isobutylene; etc. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene: or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers used in the dispersants will usually have number average molecular weights within the range of about 700 and about 5,000, more usually between about 800 and about 3000. Particularly useful olefin polymers have number average molecular weights within the range of about 900 and about 2500 with approximately one terminal double bond per polymer chain. An especially useful starting material for highly potent dispersant additives is polyisobutylene. The number average molecular weight for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography", John Wiley and Sons, New York, 1979.

Processes for reacting the olefin polymer with the $C_{4-10}$ unsaturated dicarboxylic acid, anhydride or ester are known in the art. For example, the olefin polymer and the dicarboxylic acid or derivative may be simply heated together as disclosed in U.S. Pat. Nos. 3,361,673 and 3,401,118 to cause a thermal "ene" reaction to take place. Or, the olefin polymer can be first halogenated, for example, chlorinated or brominated to about 1 to 8 wt. %, preferably 3 to 7 wt. chlorine, or bromine, based on the weight of polymer, by passing the chlorine or bromine through the polyolefin at a temperature of 60° to 250° C., e.g. 120 to 160° C., for about 0.5 to 10, preferably 1 to 7 hours. The halogenated polymer may then be reacted with sufficient unsaturated acid or derivative at 100 to 250° C., usually about 180° to 235° C., for about 0.5 to 10, e.g. 3 to 8 hours, so the product obtained will contain the desired number of moles of the unsaturated acid or derivative per mole of the halogenated polymer. Processes of this general type are taught in U.S. Pat. Nos. 3,087,936, 3,172,892, 3,272,746 and others.

Alternatively, the olefin polymer, and the unsaturated acid or derivative are mixed and heated while adding chlorine to the hot material. Processes of this type are disclosed in U.S. Pat. Nos. 3,215,707, 3,231,587, 3,912,764, 4,110,349, and in U.K. 1,440,219.

By the use of halogen, about 65 to 95 wt. % of the polyolefin, e.g. polyisobutylene will normally react with the dicarboxylic acid or derivative. Upon carrying out a thermal reaction without the use of halogen or a catalyst, then usually only about 50 to 75 wt. % of the polyisobutylene will react. Chlorination helps increase the reactivity.

At least one hydrocarbyl-substituted dicarboxylic acid material is mixed with at least one of amine, alcohol, including polyol, aminoalcohol, etc., to form the dispersant additives. When the acid material is further reacted, e.g., neutralized, then generally a major proportion of at least 50 percent of the acid producing units up to all the acid units will be reacted.

Amine compounds useful as nucleophilic reactants for neutralization of the hydrocarbyl-substituted dicarboxylic acid materials include mono- and (preferably) polyamines, most preferably polyalkylene polyamines, of about 2 to 60, preferably 2 to 40 (e.g. 3 to 20), total carbon atoms and about 1 to 12, preferably 3 to 12, and most preferably 3 to 9 nitrogen atoms in the molecule. These amines may be hydrocarbyl amines or may be hydrocarbyl amines including other groups, e.g, hydroxy groups, alkoxy groups, amide groups, nitriles, imidazoline groups, and the like. Hydroxy amines with 1 to 6 hydroxy groups, preferably 1 to 3 hydroxy groups are particularly useful. Preferred amines are aliphatic saturated amines, including those of the general formulas:

$$R-\underset{\underset{R''}{|}}{N}-R', \text{ and} \qquad \text{(IV)}$$

$$R-\underset{\underset{R'}{|}}{N}-\left[(CH_2)_s-\underset{\underset{R'''}{|}}{N}-(CH_2)_{s'}\right]_t-\underset{\underset{R'}{|}}{N}-R \qquad \text{(V)}$$

wherein R, R', R'' and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R''' can additionally comprise a moiety of the formula:

$$\left[(CH_2)_{s'}-\underset{\underset{R'}{|}}{N}\right]_{t'}H \qquad \text{(VI)}$$

wherein R' is as defined above, and wherein s and s' can be the same or a different number of from 2 to 6, preferably 2 to 4; and t and t' can be the same or different and are numbers of from 0 to 10, preferably 2 to 7, and most preferably about 3 to 7, with the proviso that the sum of t and t' is not greater than 15. To assure a facile reaction, it is preferred that R, R', R'', R''', s, s', t and t' be selected in a manner sufficient to provide the compounds of Formulas IV and V with typically at least one primary or secondary amine group, preferably at least two primary or secondary amine groups. This can be achieved by selecting at least one of said R, R', R'' or R''' groups to be hydrogen or by letting t in Formula V be at least one when R''' is H or when the VI moiety possesses a secondary amino group. The most preferred amine of the above formulas are represented by Formula V and contain at least two primary amine groups and at least one, and preferably at least three, secondary amine groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2- propylene diamine; di-(1,2-propylene)triamine; di-(1,3- propylene) triamine; N,N-dimethyl-1,3-diamino-propane; N,N- di-(2-aminoethyl) ethylene diamine; N,N-di(2-hydroxyethyl)- 1,3-propylene diamine; 3-dodecyloxypropylamine; N-dodecyl- 1,3-propane diamine; tris hydroxymethylaminomethane (THAM); diisopropanol amine; diethanol amine; triethanol amine; mono-, di-, and tri-tallow amines; amino morpholines such as N-(3-aminopropyl)morpholine; and mixtures thereof.

Other useful amine compounds include: alicyclic diamines such as 1,4-di(aminomethyl) cyclohexane, and heterocyclic nitrogen compounds such as imidazolines, and N-aminoalkyl piperazines of the general Formula (VIII):

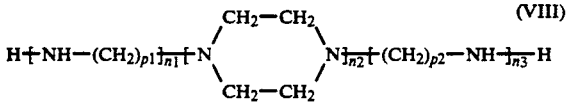

(VIII)

wherein $p_1$ and $p_2$ are the same or different and are each integers of from 1 to 4, and $n_1$, $n_2$ and $n_3$ are the same or different and are each integers of from 1 to 3. Non-limiting examples of such amines include 2-pentadecyl imidazoline; N-(2-aminoethyl) piperazine; etc. Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and isomeric piperazines. Low cost poly(ethyleneamines) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulas:

$$NH_2\text{—alkylene}\left(\text{O—alkylene}\right)_m NH_2 \quad \text{(VIII)}$$

where m has a value of about 3 to 70 and preferably 10 to 35; and $$R\left(\text{alkylene}\left(\text{O—alkylene}\right)_n NH_2\right)_a \quad \text{(IX)}$$

where "n" has a value of about 1 to 40 with the provision that the sum of all the n's is from about 3 to about 70 and preferably from about 6 to about 35, and R is a polyvalent saturated hydrocarbon radical of up to ten carbon atoms wherein the number of substituents on the R group is represented by the value of "a", which is a number of from 3 to 6. The alkylene groups in either Formula (VIII) or (IX) may be straight or branched chains containing about 2 to 7, and preferably about 2 to 4 carbon atoms.

The polyoxyalkylene polyamines of Formulas (VIII) or (IX) above, preferably polyoxyalkylene diamines and polyoxyalkylene triamines, may have average molecular weights ranging from about 200 to about 4000, and preferably from about 400 to about 2000. The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D- 2000, T-403", etc.

The amine is readily reacted with the selected hydrocarbyl-substituted dicarboxylic acid material, e.g. alkenyl succinic anhydride, by heating an oil solution containing 5 to 95 wt. % of said hydrocarbyl-substituted dicarboxylic acid material to about 100 to 250° C., preferably 125° to 175° C., generally for 1 to 10, e.g. 2 to 6 hours until the desired amount of water is removed. The heating is preferably carried out to favor formation of imides or mixtures of imides and amides, rather than amides and salts. Reaction ratios of hydrocarbyl-substituted dicarboxylic acid material to equivalents of amine as well as the other nucleophilic reactants described herein can vary considerably, depending on the reactants and type of bonds formed. Generally from 0.1 to 1.0, preferably from about 0.2 to 0.6, e.g., 0.4 to 0.6, equivalents of dicarboxylic acid unit content (e.g., substituted succinic anhydride content) is used per reactive equivalent of nucleophilic reactant, e.g., amine. For example, about 0.8 mole of a pentamine (having two primary amino groups and five reactive equivalents of nitrogen per molecule) is preferably used to convert into a mixture of amides and imides, a composition, having a functionality of 1.6, derived from reaction of polyolefin and maleic anhydride; i.e., preferably the pentamine is used in an amount sufficient to provide about 0.4 equivalents (that is, 1.6 divided by $(0.8\times5)$ equivalents) of succinic anhydride units per reactive nitrogen equivalent of the amine.

The ashless dispersant esters are derived from reaction of the aforesaid long chain hydrocarbyl-substituted dicarboxylic acid material and hydroxy compounds such as monohydric and polyhydric alcohols or aromatic compounds such as phenols and naphthols, etc. The polyhydric alcohols are the most preferred hydroxy compound and preferably contain from 2 to about 10 hydroxy radicals, for example, ethylene glycol, diethylene glycol, triethylene glycol, tetraethylene glycol, dipropylene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol, dipentaerythritol, and mixtures thereof.

The ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding the esters of this invention comprise the ether alcohols and amino alcohols including, for example, the oxyalkylene-, oxyarylene-, aminoalkylene-, and aminoarylene-substituted alcohols having one or more oxyalkylene, aminoalkylene or aminoarylene oxyarylene radicals. They are exemplified by Cellosolve, Carbitol, N,N,N',N'-tetrahydroxy-trimethylene diamine, and ether alcohols having up to about 150 oxyalkylene radicals in which the alkylene radical contains from 1 to about 8 carbon atoms.

The ester dispersant may be diesters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester dispersant may be prepared by one of several known methods as illustrated for example in U.S. Pat. Nos. 3,381,022 and 3,836,471.

Hydroxy amines which can be reacted with the aforesaid long chain hydrocarbon substituted dicarboxylic acid materials to form dispersants include 2-amino-1-butanol, 2-amino-2-methyl-1-propanol, p-(beta-hydroxyehtyl)-aniline, 2-amino-1-propanol, 3-amino-1-propanol, 2-amino-2- methyl-1, 3-propane-diol, 2-amino-2-ethyl-1, 3-propanediol, N-(beta-hydroxypropyl)-N'-(beta-aminoethyl)-piperazine, tris(hydroxymethyl) amino-methane (also known as trismethylolaminomethane), 2-amino-1-butanol, ethanolamine, beta-(beta-hydroxyethoxy)ethylamine, and the like. Mixtures of these or similar amines can also be employed. The above description of nucleophilic reactants suitable for reaction with the hydrocarbyl-substituted dicarboxylic acid material includes amines, alcohols, and compounds of mixed amine and hydroxy containing reactive functional groups, i.e., aminoalcohols.

A preferred group of ashless dispersants are those derived from polyisobutylene substituted with succinic anhydride groups and reacted with said polyethylene amines, e.g. tetraethylene pentamine, pentaethylene hexamine, polyoxyethylene and polyoxypropylene amines, e.g. polyoxypropylene diamine, trismethylolaminomethane, or said above-described alcohols such as pentaerythritol, and combinations thereof. One class of particularly preferred dispersants includes those derived from polyisobutene substituted with succinic anhydride groups and reacted with (i) a hydroxy compound, e.g. pentaerythritol, (ii) a polyoxyalkylene polyamine, e.g. polyoxypropylene diamine, and/or (iii) a polyalkylene polyamine, e.g. polyethylene diamine and tetraethylene pentamine. Another preferred dispersant class includes those derived from polyisobutenyl succinic anhydride reacted with (i) a polyalkylene polyamine, e.g. tetraethylene pentamine, and/or (ii) a polyhydric alcohol or polyhydroxy-substituted aliphatic primary amine, e.g. pentaerythritol or trismethylolaminomethane.

2. Reaction products of relatively high molecular wieght aliphatic or alicyclic halides with amines, preferably polyalkylene polyamines. These may be characterized as "amine dispersants" and examples thereof are described for example, in the U.S. Pat. Nos. 3,454,555 and 3,565,804.

3. Reaction products of alkyl phenols in which the alkyl group contains at least about 30 carbon atoms with aldehydes (especially formaldehyde) and amines (especially polyalkylene polyamines), which may be characterized as "Mannich dispersants." The materials described in the following U.S. Patents are illustrative:

U.S. Pat. No. 3,725,277
U.S. Pat. No. 3,725,480
U.S. Pat. No. 3,726,882
U.S. Pat. No. 3,980,569

4. Products obtained by post-treating the carboxylic, amine or Mannich dispersants with such reagents as urea, thiourea, carbon disulfide, phosphosulfurized hydrocarbons, aldehydes, ketones, carboxylic acids, hydrocarbon-substitued succinic anhydrides, nitrile,, epoxides, boron compounds, phosphorus compounds or the like. Exemplary materials of this type are described in the following U.S. Patents:

U.S. Pat. No. 2,805,217
U.S. Pat. No. 3,087,936
U.S. Pat. No. 3,254,025
U.S. Pat. No. 3,394,179
U.S. Pat. No. 3,511,780
U.S. Pat. No. 3,703,536
U.S. Pat. No. 3,704,308
U.S. Pat. No. 3,708,422
U.S. Pat. No. 3,850,822
U.S. Pat. No. 4,113,639
U.S. Pat. No. 4,116,876

More specifically, the nitrogen and ester containing dispersants preferably are further treated by boration as generally taught in U.S. Pat. Nos. 3,087,936 and 3,254,025 (incorporated herein by reference). This is readily accomplished by treating the selected nitrogen dispersant with a boron compound selected from the class consisting of boron oxide, boron halides, boron acids and esters of boron acids in an amount to provide from about 0.1 atomic proportion of boron for each mole of said nitrogen dispersant to about 20 atomic proportions of boron for each atomic proportion of nitrogen of said nitrogen dispersant. Usefully borated dispersants contain from about 0.05 to 2.0 wt. %, e.g. 0.05 to 0.7 wt. % boron based on the total weight of said borated nitrogen dispersant. The boron, which appears to be in the product as dehydrated boric acid polymers (primarily $(HBO_2)_3$), is believed to attach to the dispersant imides and diimides as amine salts, e.g., the metaborate salt of said diimide.

Treating is readily carried out by adding from about 0.05 to 4, e.g. 1 to 3 wt. % (based on the weight of said nitrogen dispersant) of said boron compound, preferably boric acid which is most usually added as a slurry to said nitrogen dispersant and heating with stirring at from about 135° to 190° C., e.g. 140°-170° C., for from 1 to 5 hours followed by nitrogen stripping at said temperature ranges. Or, the boron treatment can be carried out by adding boric acid to the hot reaction mixture of the dicarboxylic acid material and amine while removing water.

5. Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)substituted acrylates. These may be characterized as "polymeric dispersants" and examples thereof are disclosed in the following U.S. Patents:

U.S. Pat. No. 3,329,658
U.S. Pat. No. 3,519,565
U.S. Pat. No. 3,666,730
U.S. Pat. No. 3,702,300

All of the above-noted patents are incorporated by reference herein for their disclosures of ashless dispersants.

Lubricating oil flow improvers (LOFI) include all those additives which modify the size, number, and growth of wax crystals in lube oils in such a way as to impart improved low temperature handling, pumpability, and/or vehicle operability as measured by such tests ss pour point and mini-rotary viscometry (MRV). The majority of lubricating oil flow improvers are polymers or contain polymers. These polymers are generally of two types, either backbone or sidechain.

The backbone variety, such as the ethylene-vinyl acetates (EVA), have various lengths of methylene segments randomly distrubuted in the backbone of the polymer, which associate or cocrystallize with the wax crystals inhibiting further crystal growth due to branches and non-crystalizable segments in the polymer.

The sidechain type polymers, which are the predominan variety used as LOFI's, have methylene segments as the side chains, preferably as straight side chains. These polymers work similarly to the backbone type except the side chains have been found more effective in treating isoparaffins as well as n-paraffins found in lube oils. Representative of this type of polymer are $C_8$–$C_{18}$ dialkylfumarate/vinyl acetate copolymers, polyacrylates, polymethacrylates, and esterified styrene-maleic anhydride copolymers.

Foam control can be provided by an anti-foamant of the polysiloxane type, e.g. silicone oil and polydimethyl siloxane.

Anti-wear agents, as their name implies, reduce wear of moving metallic parts. Representative of conventional anti-wear agents which may be used to supplement the present phosphorous- and sulfur-containing reaction product mixture are the zinc dialkyl dithiophosphates, and the zinc diaryl dithiophosphates. However, it is an important advantage of the present invention that supplemental anti-wear agents do not have to be employed and, in fact, can be excluded from the compositions of this invention.

Seal swellants include mineral oils of the type that provoke swelling, including aliphatic alcohols of 8 to 13 carbon atoms such as tridecyl alcohol, with a preferred seal swellant being characterized as an oil-soluble, saturated, aliphatic or aromatic hydrocarbon ester of from 10 to 60 carbon atoms and 2 to 4 linkages, e.g. dihexyl phthalate, as are described in U.S. Pat. No. 3,974,081.

Some of these numerous additives can provide a multiplicity of effects e.g. a dispersant oxidation inhibitor. This approach is well known and need not be further elaborated herein.

Compositions, when containing these conventional additives, typically are blended into the base oil in amounts which are effective to provide their normal attendant function. Representative effective amounts of such additives are illustrated as follows:

| Compositions | (Broad) wt. % | (Preferred) Wt % |
|---|---|---|
| V.I. Improver | 1–12 | 1–4 |
| Corrosion Inhibitor | 0.01–3 | 0.01–1.5 |
| Oxidation inhibitor | 0.01–5 | 0.01–1.5 |
| Dispersant | 0.1–10 | 0.1–5 |
| Lube Oil Flow Improver | 0.01–2 | 0.01–1.5 |
| Detergent/Rust Inhibitor | 0.01–6 | 0.01–3 |
| Anti-Foaming Agents | 0.001–0.1 | 0.001–0.01 |
| Anti-wear Agents | 0.001–5 | 0.001–1.5 |
| Seal Swellant | 0.1–8 | 0.1–4 |
| Friction Modifiers | 0.01–3 | 0.01–1.5 |
| Lubricating Base Oil | Balance | Balance |

In a broad sense therefore, the hydroxy ether amine compounds of the present invention, when employed in a lubricating oil composition, typically in a minor amount, are effective to impart enhanced friction modification properties thereto, relative to the same composition in the absence of the hydroxy ether amine compounds. Additional conventional additives selected to meet the particular requirements of a selected type of lubricating oil composition also can be included as desired.

Accordingly, while any effective amount of the hydroxy ether amine additive can be incorporated into a lubricating oil composition, it is contemplated that such effective amount be sufficient to provide a given composition with an amount of the hydroxyl amine additive of typically from about 0.05 to about 5, preferably from about 0.08 to about 1, and most preferably from about 0.1 to about 0.5 wt. %, based on the weight of said composition. Similarly, while any effective amount of the herein described organic phosphite esters can be used in conjunction with the hydroxy ether amine additive, it is contemplated that such effective amount be sufficient to provide an oil composition with an amount of the phosphite ester additive of typically from about 0.1 to about 1, preferably from about 0.2 to about 0.8, and most preferably from about 0.3 to about 0.6 wt. %, based on the weight of said composition.

When other additives are employed, it may be desirable, although not necessary, to prepare additive concentrates comprising concentrated solutions or dispersions of the hydroxy ether amine compounds, or of the phosphite ester and hydroxy ether amine compounds, together with the other additives (said concentrate additive mixture being referred to herein as an additive package) whereby the several additives can be added simultaneously to the base oil to form the lubricating oil compositions. Dissoluion of the additive concentrate into the lubricating oil may be facilitated by solvents and by mixing accompanied with mild heating, but this is not essential. The concentrate or additive package will typically be formulated to contain the hydroxy ether amine compound, or the phosphite ester and the hydroxy ether amine compound combination of this invention and optional additional additives in proper amounts to provide the desired concentration in the final formulation when the additive package is combined with a predetermined amount of base lubricant. Thus, the hydroxy ether amine compound, or the phosphite ester and hydroxy ether amine compound, can be added to small amounts of base oil or other compatible solvents along with other desirable additives to form concentrates containing active ingredients in amounts of typically from about 0.1 to about 50, and preferably from about 0.7 to about 25, and most preferably from about 1.0 to about 10 wt. % additives in the appropriate proportions.

The final formulation may employ typically about 10 wt. % of the additive package with the remainder being base oil.

All of said weight percents expressed herein are based on active ingredient (a.i.) content of the additive, and/or upon the total weight of any additive package, or formulation which will be the sum of the a.i. weight of each additive plus the weight of total oil or diluent.

As noted above, the organic phosphite esters contemplated for use in this invention are characterized as possessing good compatability with the hydroxy ether amine compounds. Accordingly, lubricating oil compositions containing both of these additives exhibit excellent friction stability. This has the added benefit of permitting a reduction in the amount of hydroxy ether amine compound or other friction modifier needed to achieve the overall desired friction modification. It has been found that as the amount of hydroxy ether amine compound or other friction modifier increases in an ATF, the lower the breakaway static torque becomes. As the breakaway static torque (as well as the breakaway static coefficient of friction) decreases, the bands and clutches of the automatic transmission become increasingly more susceptible to slippage. Consequently, it is extremely advantageous to be able to control, e.g. reduce, the amount of friction modifier (and hence also any associated friction stability promoter) without sacrificing the friction modifying properties of the fluid, e.g., as measured by the torque differential $T_O$–$T_D$ and stability thereof, since this facilitates the simultaneous achievement of both the desired breakaway static torque and torque differential friction characteristics.

In short, the combination of the organic phosphite ester and the hydroxy ether amine compound permit the formulator to flexibly tailor an ATF in order to achieve the balance of properties required under today's more stringent transmission manufacturers' specifications.

The following examples are given as specific illustrations of the claimed invention. It should be understood, however, that the invention is not limited to the specific details set forth in the examples. All parts and percentages in the examples as well as in the remainder of the specification and claims are by weight unless otherwise specified.

EXAMPLE 1

A hydroxy ether amine compound of the formula

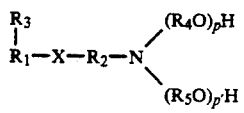

I wherein X is O; $R_1$ is a $C_{18}$ aliphatic hydrocarbon radical: $R_3$ is H; $R_2$ is $C_3$ alkylene; and $R_4$ and $R_5$ are both $C_2$ alkylene radicals; and p and p' are each 1, was prepared by first reacting 270 parts by weight of octadecenyl alcohol with 53 parts by weight of acrylonitrile in the presence of an acid or basic catalyst at a temperature in the range of 20° to 60° C. for about 6 hours to form an ether nitrile intermediate. The intermediate was then hydrogenated in the presence of a Raney nickel catalyst at a temperature in the range of from 140° to 150° C. for about 2 hours to form an ether amine. The ether amine was then reacted with 44 parts by weight of ethylene oxide in the presence of a base catalyst at a base temperature in the range of about 150° C. for 6 hours to form the hydroxy ether amine product.

EXAMPLE 2

An ATF base fluid, designated hereinafter as the Test Base, was formulated with conventional amounts of seal swell additive, dispersant, antioxidant, viscosity index improver and mineral oil base.

To a sample of the Test Base there was added 0.5 wt. % of triphenyl phosphite (TPP) and 0.2 wt. % of a thiobisethylene dodecyl succinate hemiester having the formula:

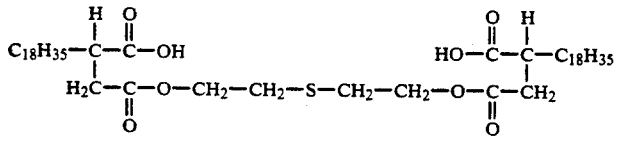

X

The resulting formulation is designated Comparative Formulation 1C.

To another sample of the Test Base there was added 0.2 wt. % of $C_4/C_5$ dialkyldithiophosphate (ZDDP) and 0.2 wt. % of the hydroxy ether amine friction modifier that was prepared in accordance with EXAMPLE 1. The resulting formulation is designated Comparative Formulation 2C.

To another sample of the Test Base there was added 0.2 wt. % of ZDDP and 0.2 wt. % of the same friciton modifier that was used in Formulation 1C. The resulting formulation is designated COMPARATIVE FORMULATION 3C.

To another sample of the Test Base there was added 0.5 wt. % of TPP and 0.2 wt. % of the same hydroxy ether amine friction modifier that was used in Formulation 2C. The resulting formulation is designated Formulation 4.

To another sample of the Test Base there was added 0.5 wt. % of dioleyl phosphite (DOP) and 0.2 wt. of the same hydroxy ether amine friciton modifier that was used in Formulation 4. The resulting formulation is designated COMPARATIVE Formulation 5C.

The compositions of Formulation 1C–5C are summarized in Table 1 as follows:

TABLE 1

| | Formulation Number | | | | |
|---|---|---|---|---|---|
| Component, wt % | 1C | 2C | 3C | 4 | 5C |
| dioleyl phosphite | — | — | — | — | 0.5 |
| triphenyl phosphite | 0.5 | — | — | 0.5 | — |
| hydroxy ether amine | — | 0.2 | — | 0.2 | 0.2 |
| succinate hemiester (Formula IV) | 0.2 | — | 0.2 | — | — |
| zinc dialkyldithio-phosphate | — | 0.2 | 0.2 | — | — |
| Test Base | 99.3 | 99.6 | 99.6 | 99.3 | 99.3 |

The above Formulations were then tested in accordance with a modified SAE No. 2 Friction Test and a Vickers AW Test.

4000 CYCLE FRICTION TEST

This test uses a SAE No. 2 type friction machine operated successfully for 4000 cycles wherein no unusual clutch plate wear or composition-face plate flaking occurs. The test is conducted in a continuous series of 20 second cycles, each cycle consisting of three phases as follows: Phase I (10 seconds)—motor on at speed of 3,600 rpm, clutch plates disengaged; Phase II ( 5 seconds)—motor off, clutch plates engaged; and Phase III (5 seconds)—motor off, clutch plates released. 4000 cycles are repeated using 20,740 J. of flywheel energy at 40 psi. of applied clutch pressure. During the clutch engagement, friction torque is recorded as a function of time as the motor speed declines from 3600 rpm to 0. From the torque traces, the dynamic torque ($T_D$) is determined midway between the start and end of clutch engagement (i.e. at a motor speed of 1800 rpm), as well as the torque ($T_O$) just before lock-up, e.g. between 20 and 0 rpm. The amount of time in seconds in phase II it takes for the motor speed to go from 3600 to 0 rpm is referred to as the lock-up time. The torque ratio of the oil formulation is then determined from ($T_O/T_D$). In addition to determining midpoint dynamic torque ($T_D$) and static torque ($T_O$), the breakaway static torque ($T_S$) is also determined. This is achieved by rotating the composition plates at 2 to 3 rpm under a load of 40 psi. while locking the steel reaction plates and preventing them from rotating. The torque is then measured until slippage occurs. The maximum torque observed is recorded as $T_S$. From $T_S$ is determined the Breakaway Static Torque ratio ($T_S/T_D$).

The breakaway static torque ratio expresses the ability of the transmission to resist slippage; the lower the ratio, the higher the slippage.

The test results for Formulations 1C–5C are shown in Table 2. The data reported in Table 2 was measured after 200 and 4000 cycles of operation.

TABLE 2

| | 4000 CYCLE FRICTION TEST | | | | | |
|---|---|---|---|---|---|---|
| Test Formulation | Test Cycle | $T_D$ (N · m)[1] | $T_S$ (N · m)[2] | $T_O/T_D$[3] | $T_S/T_D$[5] | $\Delta T_S$[4] |
| 1C | 200 | 136 | 110 | 0.89 | 0.74 | — |
| 2C | 200 | 132 | 106 | 0.95 | 0.80 | — |
| 3C | 200 | 136 | 113 | 0.94 | 0.83 | — |
| 4 | 200 | 142 | 122 | 0.99 | 0.86 | — |
| 5C | 200 | 132 | 94 | 0.86 | 0.71 | — |
| 1C | 4000 | 140 | 119 | 0.97 | 0.85 | 19 |
| 2C | 4000 | 130 | 106 | 0.95 | 0.77 | 0 |
| 3C | 4000 | 140 | 137 | 1.03 | 0.98 | 24 |
| 4 | 4000 | 127 | 117 | 0.91 | 0.71 | 5 |
| 5C | 4000 | 138 | 85 | 0.83 | 0.62 | 15 |

1 = acceptable range for $T_D$ is 120–150
2 = acceptable range for $T_S$ is 90–130
3 = acceptable range for $T_O/T_D$ is 0.90–1.0
4 = change in $T_S$ from 200 to 4000 cycles; 40 is maximum acceptable $\Delta T_S$; reflects friction durability
5 = acceptable range for $T_S/T_D$ = 0.6–1.1

As can be seen from Table 2, Formulation 1C resulted in a $T_O/T_D$ value which is unacceptable at 200 cycles The change in $T_S$ measured between 200 cycles and 4000 cycles of 19 for Formulation 1C and 24 for Formulation 3C also is much higher than obtained for Formulation 4. Formulation 2C shows acceptable friction data, but, as can be seen hereinafter in connection with Vickers anti-wear data, Formulation 2C shows poor wear characteristics. Accordingly, it will be apparent that Formulations 1C, 2C and 3C represent less desirable formulations.

Formulation 4 resulted in acceptable values for all of $T_D$, $T_S$, $T_O/T_D$ after 200 cycles. The $T_O/T_D$ value of 0.99 after 200 cycles is at the high end of the acceptability range, and would result in satisfactory shift feel in a vehicle. Comparing the 200 cycle data to the 4000 cycle data gives an indication of friction durability. By this comparison, it can be seen that for Formulation 4, $T_S$ changes only 5 N.m. This change is much lower than the allowable change for the test. The data show that Formulation 4 has excellent friction retention and meets all acceptable parameter limits as shown.

With respect to Formulation 5C, the data show 4000 cycle $T_S$ and 200 and 4000 cycle $T_O/T_D$ values which are lower than the allowable limits.

The data in Table 2 thus demonstrates the superior friction properties of an ATF formulated with a hydroxyl amine friction modifier of the present invention over a similar ATF formulation containing a conventional friction modifier which is outside the scope of the invention.

VICKERS ANTI-WEAR TEST

This vane pump wear test is fully described in ASTM procedure D2882. It uses a constant volume high pressure vane pump to indicate wear characteristics of petroleum and non-petroleum hydraulic fluids. The procedure used in the test conducted herein differs from the ASTM D2882 only in pump outlet pressure (1000 psi vs. 2000 psi) and fluid temperature (175° F.).

The conditions for the test are as follows:

| | |
|---|---|
| Pump Outlet Pressure | 1000 + 20 psi |
| Fluid Temperature, Pump Inlet | 175 + 5° F. |
| Pump Speed | 1200 + 60 rpm |
| Fluid Charge | 3 gal. |

The Vickers 104C vane pump cartridge is used for the testing. At the end of 24 hours of test time and again at the end of 100 of test time, the cam ring and vanes are measured for total weight loss. The maximum weight loss permitted in this test is 15 mg.

The test results for Formulations 1C–5C are shown in Table 3.

TABLE 3

| | VICKERS ANTI-WEAR TEST | | | | |
|---|---|---|---|---|---|
| Vickers Ring and | Formulation | | | | |
| Vanes wt. loss, mg. | 1C | 2C | 3C | 4 | 5C |
| 24 hrs. | 3.8 | 329.1 | 25.0 | 0.8 | 2.8 |
| 100 hrs. | 10.1 | 634.2 | 73.4 | 5.6 | 3.9 |

Referring to Table 3, it can be seen that the results for Formulation 4, which contains both the hydroxy ether amine friction modifier and triphenyl phosphite, are superior to those for all of the other formulations at 24 hrs., including those for Formulations 2C and 5C, which contain the same hydroxy ether amine friction modifier but either ZDDP (Formulation 2C) or dioleyl phosphite (Formulation 5C) instead of triphenyl phosphite. Only formulation 5C at 100 hrs has better wear, but as shown at Table 2, this formulation has poor friction performance. The formulations which replace the hydroxy ether amine friction modifier with the succinate hemiester friction modifier show inferior test results regardless of whether the formulation includes triphenyl phosphite (Formulation 1C) or ZDDP (Formulation 3C).

The data in Tables 2 and 3 collectively demonstrate the advantage of using triphenyl phosphite (TPP), in combination with the hydroxy ether amine, over ZDDP or dioleyl phosphite as the anti-wear additive.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. An automatic transmission fluid which comprises:
(a) mineral oil;
(b) 0.05-5.0 weight % of total fluid of a borated or unborated hydroxy ether amine compound having the formula:

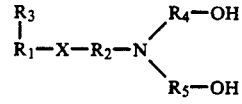

wherein X represents O, $R_1$ represents a $C_3$–$C_{27}$ saturated or unsaturated aliphatic hydrocarbon radical, $R_2$ represents a straight chain $C_1$–$C_6$ alkylene radical, $R_3$ represents H or $CH_3$, and $R_4$ and $R_5$, independently, represent straight chain $C_2$–$C_5$ alkylene radicals, said hydroxy ether amine compound having from 10 to 30 total carbon atoms; and (c) 0.1–1 weight % of total fluid of an organic phosphite ester having the formula

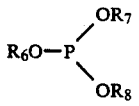

wherein $R_6$ represents a hydrocarbyl radical selected from the group consisting of aryl and $C_1$–$C_3$ alkaryl, and $R_7$ and $R_8$, independently, represent a hydrocarbyl radical selected from the group consisting of $C_1$–$C_{25}$ alkyl, aryl, $C_1$–$C_3$ alkaryl, $C_5$–$C_8$ cycloalkyl, and halo-substituted derivatives thereof.

2. The composition of claim 1, wherein $R_1$ represents a $C_{16}$–$C_{20}$ alkylene radical and $R_2$ represents a $C_2$–$C_4$ alkylene radical.

3. The composition of claim 2, wherein $R_1$ is $C_{18}$ alkylene, $R_2$ is $C_3$ alkylene, $R_3$ is H, and $R_4$ and $R_5$ are $C_2$ alkylene.

4. The composition of claim 2, wherein said hydroxy ether amine compound has been borated.

5. The composition of claim 4, wherein said organic phosphite is present in an amount of from about 0.1 to about 1 wt. % based on the weight of the composition.

6. The composition of claim 5, wherein $R_6$, $R_7$ and $R_8$ are selected from the group consisting of alkyl, aryl an alkaryl radicals.

7. The composition of claim 6, wherein $R_6$, $R_7$ and $R_8$ are selected from the group consisting of aryl radicals.

8. The composition of claim 1, wherein the organic phosphite ester is triphenyl phosphite.

9. The composition of claim 3, wherein the organic phosphite ester is triphenyl phosphite.

* * * * *